US006397854B1

(12) United States Patent
Bailey

(10) Patent No.: US 6,397,854 B1
(45) Date of Patent: Jun. 4, 2002

(54) BENDABLE FABRIC-COVERED ROD-LIKE DEVICE

(76) Inventor: Heather Bailey, P.O. Box 481232, Los Angeles, CA (US) 90048

( * ) Notice: Subject to any disclaimer, the term of this patent is extended or adjusted under 35 U.S.C. 154(b) by 0 days.

(21) Appl. No.: 09/589,895

(22) Filed: Jun. 7, 2000

Related U.S. Application Data

(60) Provisional application No. 60/137,906, filed on Jun. 7, 1999.

(51) Int. Cl.[7] ..... A45D 8/00

(52) U.S. Cl. ..... 132/200; 132/246; 24/30.5 T; 24/27

(58) Field of Search ..... 132/246, 247, 132/200, 273, 275; 24/30.5 T, 27, 715.4, 713, 713.1; 63/3, 11, 15

(56) References Cited

U.S. PATENT DOCUMENTS

| | | | | | |
|---|---|---|---|---|---|
| 1,158,957 | A | * | 11/1915 | Bates | 24/27 |
| RE15,363 | E | * | 5/1922 | McClaire | 132/246 |
| 1,530,854 | A | * | 3/1925 | Putt | 132/246 |
| 1,908,970 | A | * | 5/1933 | Frankel | 132/246 |
| 4,577,647 | A | | 3/1986 | Fenster | 132/39 |
| 4,648,414 | A | | 3/1987 | Fox | 132/43 R |
| 5,029,372 | A | * | 7/1991 | Brinson | 24/715.4 |
| 5,372,152 | A | | 12/1994 | Dutch | 132/246 |
| 5,499,638 | A | * | 3/1996 | Ripley | 132/273 |
| 5,655,224 | A | * | 8/1997 | Sears | 2/171 |
| 5,664,589 | A | | 9/1997 | Black | 132/246 |
| 5,706,838 | A | * | 1/1998 | St. James | 132/246 |
| 5,875,792 | A | | 3/1999 | Campbell | 132/246 |
| D430,704 | S | * | 9/2000 | Spurell et al. | D28/39 |

* cited by examiner

*Primary Examiner*—Gene Mancene
*Assistant Examiner*—David Comstock

(57) ABSTRACT

A personal grooming device and method for making such, comprising an elongate flexible member encased in a flexible fabric or leather sheath. The fabric encasement or sheath is secured beyond each end of the encased wire, so as to prevent the separation of parts. Securement is achieved by knotting the fabric encasement or cord beyond each end of the encased wire. Articles of this invention may be of any desired length to be used for many purposes. Such uses include a hair fastener, a hair holder for a ponytail, a hair curling rod, a headband, a necklace, a bracelet or for other uses unrelated to personal grooming.

8 Claims, 3 Drawing Sheets

BENDABLE FABRIC-COVERED ROD-LIKE DEVICE

CROSS REFERENCE TO RELATED APPLICATIONS

This application is entitled to the benefit of Provisional Patent Application Ser. No. 60/137,906 filed Jun. 7, 1999.

TECHNICAL FIELD

This invention relates to bendable fabric-covered rod-like articles that may be readily bent for a variety of purposes and more particularly, for personal grooming. In this regard, the articles may be of any desired length to be used as a hair fastener, a hair holder for a ponytail, a hair curling rod, a headband, or even a necklace, or bracelet. Other uses unrelated to personal grooming may readily come to mind for use of articles of this invention.

BACKGROUND OF THE INVENTION

Numerous devices are known for styling hair. One common type of device comprises an elastic band which may be used to encircle a bundle of hair to create a ponytail or secure the ends of a braid. A problem with this device is that it must often be encircled around a bundle of hair two or three times. Once it is tightly encircled around a bundle of hair, numerous hairs tend to get caught within its circles. Consequently, it is difficult to remove the device without also removing a quantity of hair. Furthermore, these elastic bands are often inserted so tightly that the scalp can become sore and irritated.

Other devices clip onto, or around, a bundle of hair. The most common of these devices is the barrette. A problem with these devices is that the clip is not adjustable for use with different size bundles and thicknesses of hair. As a result, a barrette may work fine with an average size bundle of medium-weight hair, but the same barrette may have too large and cumbersome of a clip to be used on a bundled of very fine hair. The barrette may also have too small of a clip to engage a large bundle of extremely dense hair.

Other known personal grooming devices comprise a bendable member which may, in fact, encircle different size bundles and weights of hair. Examples of such devices are described in U.S. Pat. No. 4,648,414 to Fox, et al. (1987), U.S. Pat. No. 5, 875,792 to Campbell, et al. (1999), and U.S. Pat. No. 4,577,647 to Fenster, et al. (1986), wherein described devices are comprised of a bendable member encased in a foam covering. Many such foam covered devices serve first as an apparatus with which hair is curled and not as a decorative accessory. However, in the cases where these foam covered devices are worn to accessorize as well as fasten the hair, they can often appear "clunky" and add unnecessary weight to the hair. Also, the foam covering is rather limited in the variety of textures and patterns with which it may be created. Furthermore, these foam covered devices require specialized and often very expensive machinery to produce. U.S. Pat. No. 5,664,589 to Black (1997), presents a similar bendable article encased in vinyl plastisol, presenting the same limitations in texture and pattern as well as expensive equipment. And, U.S. Pat. No. 5,372,152 to Dutch (1994), though encased in fabric, is limited merely to the functions of a hair roller and still incorporates foam at it's center, resulting in a similarly bulky and "clunky" appearance. Subsequently, the hair styling devices heretofore known suffer from a number of disadvantages.

A need therefore exists for a fashionable article of personal grooming that, when used to fasten hair, is comfortable to wear, does not rip hair out when removed, is adjustable to a variety of hair textures, is lightweight and aesthetically pleasing in appearance, is available in wide variety of textures and patterns, and inexpensive to create.

SUMMARY OF THE INVENTION

In accordance with one aspect of the present invention, a personal grooming device is provided. This device comprises an elongate flexible member encased in an elongate flexible sheath. The flexible member is preferably a wire with two cut ends made blunt either by dipping the two cut wire ends in a substance which hardens into a rounded tip at each end of the wire or by bending or folding the cut wire ends back along the wire to form a loop. The encasement or sheath is secured at each end of the encased wire, so as to prevent the separation of parts. The encasement is preferably made of narrow fabric or leather tubing, cord, or strips of fabric or leather sewn together to make a narrow casing. Encasement made of fabric or leather will be referred to as "fabric encasement,""fabric tubing," or the like. Preferable closure is achieved by a knot in the fabric tubing or cord at each end of the encased wire or by sewing the ends shut. Another preferred closure is achieved by tightly binding the fabric tubing or cord beyond the encased flexible member with plastic tips, as is seen on the ends of shoelaces. Articles of the present invention may be of any desired length to be used as a hair fastener, a hair holder for a ponytail, a hair curling rod, a headband, or even a necklace or bracelet.

In accordance with another aspect of the present invention, a method for fastening an amount of hair is provided. The method includes the step of laying an amount of hair over the shaft of the fastener device. The method continues with the step of crossing the two ends of the fastener device around the amount of hair and then twisting the fastener device ends toward each other so as to hook the two ends into place around the amount of hair.

OBJECTS AND ADVANTAGES

Accordingly, several objects and advantages of my invention are:

(a) to provide a hair fastener that is comfortable to wear as well as quick and easy to insert;

(b) to provide a hair fastener that is adjustable for a wide range of hair textures and thicknesses;

(c) to provide a hair fastener that is lightweight and aesthetically pleasing in appearance.

(d) to provide a hair fastener that is available in the endless variety of textures and patterns available in fabric. Articles of this invention can even be made of fabric exactly matching an article of apparel, an advantage that the prior art does not offer;

(e) to provide a hair fastener that is inexpensive to produce and does not require new specialized machinery to create;

Further objects and advantages are to provide articles which may be appropriately worn for a variety of occasions, from casual to formal, which promote creativity in hair styling by the endless styling possibilities they offer, which can be combined by twisting or hooking two or more articles together for an even greater variety of hair styles, and which may be used in a variety of ways other than to accessorizes or fasten hair, such as in a bracelet, necklace, or anklet. Still further objects and advantages of my invention will become apparent from a consideration of the drawings and ensuing description.

BRIEF DESCRIPTION OF THE DRAWINGS

A more complete understanding of the invention can be had by referring to the following Detailed Description and Operation, taken with the accompanying drawings, wherein:

FIG. 4 showing the articles used as hair fasteners, FIG. 5 showing the article used as a headband, and FIG. 6 showing the article used as a novelty wrist bracelet.

LIST OF REFERENCE NUMERALS

| | | | |
|---|---|---|---|
| 10 | personal grooming device | 20 | fabric tubing |
| 22 | knots in fabric tubing | 24 | tail of fabric tubing |
| 26 | wire | 28 | cut end of wire |
| 30 | material for burying sharp ends of wire | 32 | plastic "shoelace" tips |
| 50 | flexible member | 60 | hair |

DETAILED DESCRIPTION

Figure 1A:
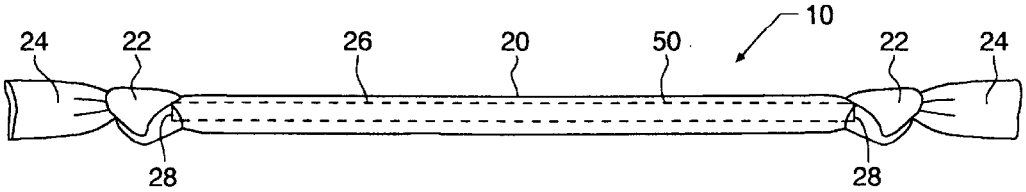
FIG. 1A is a plan view of a device forming a first embodiment of the present invention.
Figure 1B:
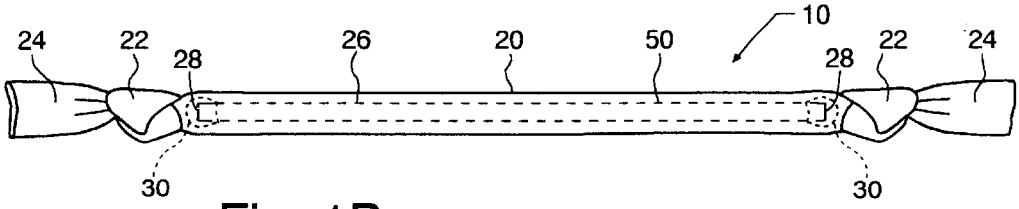
FIGS. 1B–C are plan views of variations on the device of FIG. 1A.

Referring to the drawings, wherein like reference numerals designate like or corresponding parts throughout the several views, and in particular to FIGS. 1A, and 1B, there is illustrated a rod-like device 10 forming a first embodiment of the present invention. The device 10 may generally comprise a relatively elongate and flexible member 50 which is encased in fabric tubing 20.

Having thus described the device 10 in general, the device 10 will now be described in further detail.

In a first preferred embodiment, the device 10 comprises a flexible member 50 encased in fabric tubing 20. In FIG. 1A, the flexible member further comprises a wire 26 with two cut wire ends 28, which is sandwiched between two knots 22 in the fabric tubing 20. The fabric tubing 20 is pulled tightly along the shaft of the wire 26 when knotted so as to bury the cut wire ends 28 into the knots 22. This helps prevent the wire 26 from poking through the fabric tubing 20. In FIG. 1B, a preferred variation on the first embodiment of my invention, the cut wire ends 28 are dipped in a substance which hardens into a rounded tip 30 on each cut wire ends 28. This substance may be a plastic, vinyl, acrylic, or other substance which achieves the desired results of a rounded tip 30 at each cut wire end 28. These rounded tips 30 further ensure that the wire 26 will not poke through the fabric tubing 20. Otherwise, the wire ends 28 may simply be bent into a small loop to create two blunt ends on the flexible member, as in FIG. 1C.

The wire 26 is preferred to be an aluminum-based alloy. The alloy is lightweight and it allows the wire 26 to flex repeatedly without breaking. Aluminum alloy further resists corrosion, allowing this personal grooming device to be hand-washable depending on the fabric and materials used as the outer sheath. However, the wire 26 could be made of a steel alloy, copper, or other metal, or metal alloys. The wire 26 is of sufficient strength and gauge to hold its shape when wrapped around a quantity of hair.

The fabric tubing 20 which encases the assembled flexible member 50 is created from a narrow strip of fabric which is sewn into a tube 20 with the seams turned to the inside of the tube. The seams could also be left visible for decorative effect. The fabric tubing 20 covers the entirety of the flexible member 50 and is of a relatively uniform diameter along the length of the flexible member 50. The flexible member is inserted into the fabric tubing 20, a knot 22 is created in the fabric tubing 20 at one end, then the fabric tubing 20 is pulled taught over the flexible member 50 as the second knot 22 is created at the opposite end of the flexible member 50. The fabric tubing 20 is then trimmed beyond the two knots 22, leaving a tail of fabric tubing 24 at each end that can range from approximately ¼ inch to ½ inch in length. The diameter of the flexible member may vary, with a preferred gauge of fourteen. The diameter of the fabric tubing 20 may vary also, with preferred diameters ranging from three-sixteenth inch to five-sixteenth inch. Fabric tubing or cord of the preferred diameter offers a comfortable and lightweight alternative to the clunky, clingy foam encasing of the prior art foam articles.

The endless variety of fabrics which may be used to create the fabric tubing 20 is an important feature which allows for the device 10 to be produced in fabrics which are appropriate to a full spectrum of occasions. Examples of fabrics which may be used include satin, denim, gingham, leather, fur, velvet, vinyl cloth, faux fur and more. Users may find devices made with cotton gingham to be appropriate at the beach, and may find devices created with satin to be appropriate for a formal dinner party. It is a further advantage that articles of this invention may be produced of fabrics to exactly match specific articles of apparel, including prints and patterns, an advantage over the flexible foam articles of prior art. For instance, the device made of pink floral fabric tubing may be sold in conjunction with a pink floral blouse made of identical material.

Many fabrics may be chosen for their soft and supple textures to add even greater comfort for the user and gentleness on the hair which is fastened. Fibers that generally create soft and supple fabrics may be silk, leather, microfiber, rayon, or polyester. Examples of generally soft and supple fabric weaves are charmeuse, satin, and brushed twill. Articles of this invention may be created with fiber contents and fabric weaves such as these, but will not be limited to those specifically mentioned above.

Figure 1C:
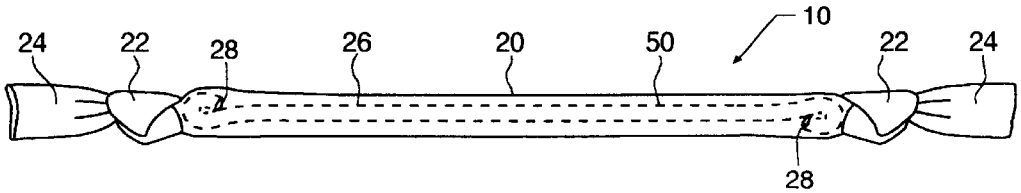
Figure 2:
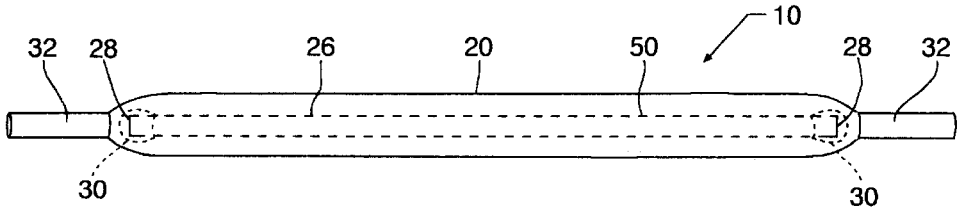
FIG. 2 is a plan view of a second preferred embodiment of the present invention.

A second preferred embodiment of the device 10 is found in FIG. 2. In this embodiment, the flexible member 50 is once again encased in fabric tubing 20, which may consist of a tightly woven or knitted cord similar to shoelace cord. However, the ends of the fabric tubing 20 are tightly bound beyond the encased flexible member 50 with cylindrical plastic tips 32, like at the end of a typical shoelace. The length of the cylindrical plastic tips 32 may range from approximately one-fourth inch to approximately five-eighths inch. Again, the flexible member 50 used for the device 10 may be the same preferred flexible member 50 shown in FIG. 1B, in which the cut wire ends 28 are dipped into a substance which hardens into a rounded protective tip 30 at each end of the wire 26. These rounded tips 30 further prevent the wire ends 28 from poking through the fabric tubing 20. Likewise, the wire ends 28 of the flexible member may simply be bent into a loop to provide blunt ends, as the flexible member is illustrated in FIG. 1C.

Figure 6:
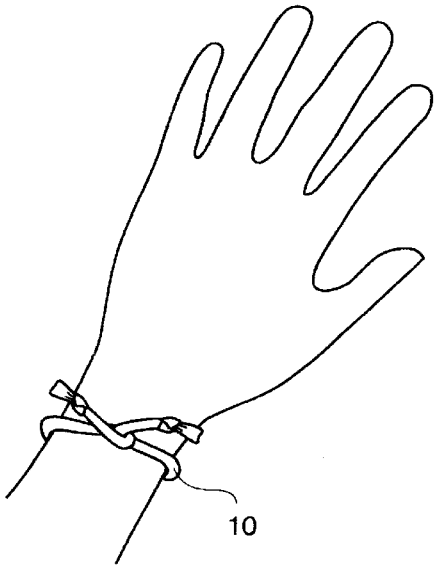

The complete device 10 of FIGS. 1A, B, and 2 may vary in length, with preferred lengths ranging from three inches for a small hair fastener to twenty-five inches for a headband. The encased flexible member 50 may also vary in length, with preferred lengths ranging from approximately two inches to approximately twenty-four inches. The various lengths may be used for different purposes, including a ponytail holder, a bracelet (as in FIG. 6), an anklet, a necklace and more.

Figure 4:
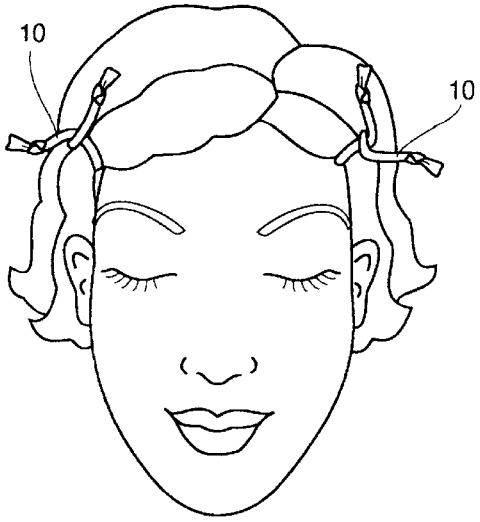
FIGS. 4, 5, and 6 show various environmental uses of the articles of this invention.
Figure 5:
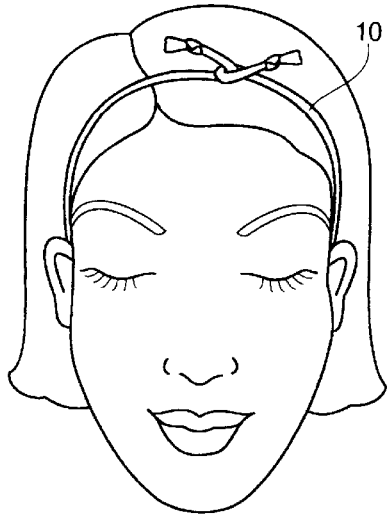

Various hair styles may be achieved using the hair accessory device. Although users of the hair accessory devices shown will want to make use of varying lengths and widths of the devices, in order to create more advanced or unusual hair styles, specific embodiments of the device are tailored to special uses. However, it will be noted that each device is adjustable to various hair textures and thicknesses. The smaller devices (those which are approximately three to four inches in length and approximately three-sixteenths inch cross-sectional diameter) are especially useful in managing smaller quantities of hair (as in FIG. 4). One device or multiple devices may be worn at the same time, creating a multitude of hairstyles. Devices of approximately six inches in length and three-sixteenths inch in diameter are excellent for creating and decorating ponytails, pigtails and braids. And, devices of approximately twenty- five inches in length may be used as a headband (as in FIG. 5).

Figure 8A:
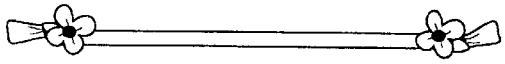
FIGS. 8A–B show some ways in which this invention may be embellished.
Figure 8B:
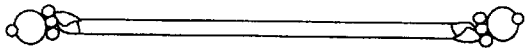

The encasing fabric sheath 20 of the device 10 can be secured with knots 22 beyond each end of the encased wire 26 as shown in FIGS. 1A and 1B, with plastic "shoelace" tips 32 as in FIG. 2, or sewn, bound, welded, glued, clamped, riveted or otherwise sealed. Also, for decorative purposes, a variety of elements may be attached to the ends or along the sheath of the present invention. Examples of such decorative details may be beads, silk flowers, buttons, ribbons, yarn, appliques and more. In FIG. 8A, an example of a floral embellishment is depicted. And, in FIG. 8B, an example of beaded embellishment is depicted. Also, decorative stitching or seaming may be applied along the sheath of fabric. For example, when the fabric sheath is created using two fabrics seamed together along the length of the sheath, various trims can be inserted into the seam(s) or sewn or otherwise applied on top of the seam(s).

Therefore, it will be understood that the invention is not limited to the embodiments disclosed, but is capable of numerous rearrangements, modifications and substitutions of parts and elements without departing from the spirit of the invention. And, other uses unrelated to personal grooming may readily come to mind for use of articles of this invention.

OPERATION

Figure 3A:
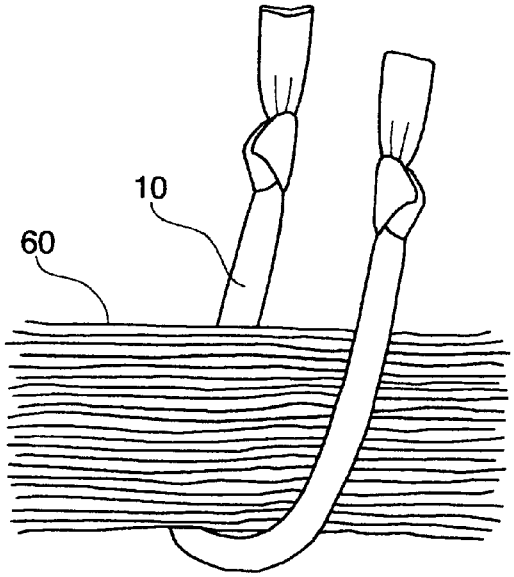
FIGS. 3A–C illustrate a use of the device to fasten an amount of hair.
Figure 3B:
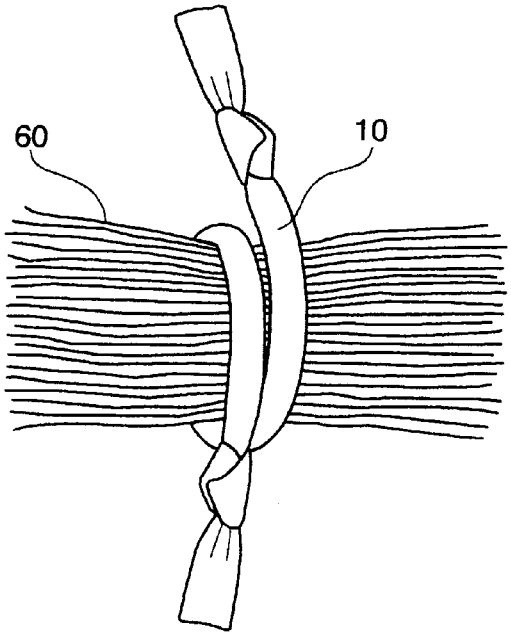
Figure 3C:
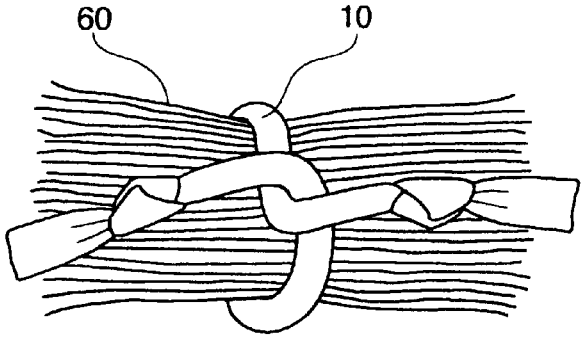

Referring to FIGS. 3A–3C, a manner of using an article of the invention is illustrated with the first embodiment of the invention depicted. Namely, one first bends the device 10 in half, creating a "U" shape. An amount of hair 60 is then placed through the center of the "U" shape, as in FIG. 3A. Next, the two ends of the device 10 are crossed around the amount of hair 60, as in FIG. 3B. Finally, the two ends of the device 10 are twisted toward each other, hooking them into place, as in FIG. 3C.

The foregoing is one method of using articles of this invention, however, there are many ways in which the device may be used, according to the user's creativity. Not only may the device be used in the manner illustrated in FIGS. 3A–3C, but the device may be wrapped around an amount of hair several times forming a coil, or the two ends of the device may be twisted toward each other several times, like a wire garbage tie is typically twisted. Once the hair accessory device is wrapped or twisted around a quantity of hair, the device may be further bent to achieve unusual hair styles. Alternatively, the device may be bent in some stylish form before it is used in one's hair. The device may be removed by untwisting or unwrapping it, and it may then slide gently from one's hair, without tearing out or damaging hairs.

Figure 7:
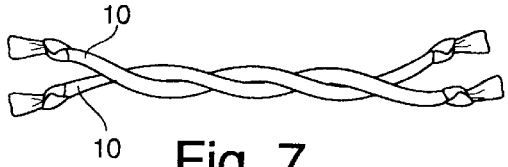
FIG. 7 is a side view of articles of this invention novelly twisted together prior to use.

Similar operations of twisting or wrapping varying lengths of the device loosely around the head, the wrist, the leg, or the neck will result in alternative embodiments of the invention as a headband (as in FIG. 5), a bracelet (as in FIG. 6), an anklet, or a necklace, respectively. Articles of this invention used as headbands are comfortable for the user because the device is adjusted to the wearer's individual head size and shape. For this reason, the device worn as a headband need not be worn uncomfortably tight to stay in place and perform its practical and decorative functions. Also, in general, two identical devices or devices of differing color, pattern, texture and/or length may even be combined by twisting them together (as in FIG. 7) prior to use in one's hair. Or, two devices may be hooked together at their ends to achieve the functional and aesthetic features of a longer device. Styling methods are limited only by a user's imagination.

CONCLUSION, RAMIFICATIONS AND SCOPE OF INVENTION

Accordingly the reader will see, from the Detailed Description and Operation above, a number of advantages of my personal grooming device become evident:

a) The device, comprised of lightweight materials, adjustable to various hair textures and thicknesses and which does not put any undue strain on the user's scalp, is comfortable to wear. The device is also quick and easy to use and does not tear out or damage hair when it is removed.

b) As described in the foregoing Operation, the manner in which the device may be used to fasten an amount of hair applies to a variety of hair textures and weights, proving the device highly adjustable.

c) The preferred embodiments of the present invention utilize an aluminum alloy wire in combination with narrow fabric tubing or cord, materials which result in a lightweight and aesthetically pleasing device for fastening and decorating hair when combined in the manner described in the foregoing Detailed Description.

d) An infinite variety of fabric prints, textures and colors may be used to create the fabric tubing with which the device is made. And the device may be embellished with a large variety of decorative features such as beads, silk flowers, buttons, ribbons, appliques, yarns, trims, embroidery and more. Furthermore, articles of this invention may be produced of fabrics to exactly match specific articles of apparel.

e) Seeing as devices of this invention are made using common and inexpensive tools such as, a sewing machine, wire cutters and scissors, elaborate specialized machinery need not be created for the production of articles of this invention. Articles of this invention may even be created by the same contractor who is producing a line of clothing the devices are intended to accessorize, reducing overall cost and lead time for the manufacturer by making the devices "in house."

It is evident that articles of this invention may be worn for a variety of occasions, depending on the fabric or cord used and the user's preferences. With the variety of fabric prints, textures and colors that the device can be made with and the endless possibilities for combining and placing the devices in the hair, the invention may clearly promote creative hair styling. And it is an additional advantage that articles of this invention may be used in a variety of ways other than to accessorize or fasten hair. Examples of such additional uses include a bracelet, an anklet and a necklace.

In the drawings and specification there have been set forth preferred embodiments of the invention, and although specific terms are employed, they are used in a generic and descriptive sense only, and not for purposes of limitation. Thus, the scope of the invention should be determined with the appended claims in which encasement made of fabric or leather will be referred to as "fabric encasement."

What is claimed is:

1. A personal grooming device, comprising:

(a) an elongate flexible member comprised of an aluminum or an aluminum alloy wire;

(b) an elongate fabric encasement; and (c) means for securing said elongate fabric encasement so as to encase said elongate flexible member and prevent the separation of parts, said means including a knot tied in said elongate fabric encasement beyond each end of the encased flexible member and having a fabric tail extending from the knot.

2. The personal grooming device of claim 1, further including embellishments applied to said personal grooming device.

3. The personal grooming device of claim 1, wherein said elongate fabric encasement has a relatively uniform cross-section along its length.

4. The personal grooming device of claim 1, wherein the cross-section of said elongate fabric encasement is approximately three-sixteenths inch to five-sixteenths inch, and wherein the length of said elongate flexible member is approximately three to four inches.

5. The personal grooming device of claim 1, wherein the cross-section of said elongate fabric encasement is approximately three-sixteenths inch to five-sixteenths inch, and wherein the length of said elongate flexible member is approximately six inches.

6. The personal grooming device of claim 1, wherein the cross-section of said elongate fabric encasement is approximately three-sixteenths inch to five-sixteenths inch, and wherein the length of said elongate flexible member is approximately twenty-five inches.

7. A method of making a flexible personal grooming device comprising the steps of:

(a) providing an elongate flexible member comprised of an aluminum or aluminum alloy wire; cutting a predetermined length of the flexible member; dipping each cut end of the flexible member into a substance that hardens into a blunt tip on each end of the flexible member;

(b) inserting said elongate flexible member into an elongate fabric encasement;

(c) securing said elongate fabric encasement beyond each end of the encased flexible member, so as to prevent the separation of parts, wherein said elongate fabric encasement is knotted at each end thereof and then cut beyond the knotted ends to leave an extending tail portion of fabric from each knotted end.

8. The method of claim 7 including the step of applying embellishments to said personal grooming device.

* * * * *